United States Patent [19]

Eriksson et al.

[11] 4,271,987

[45] Jun. 9, 1981

[54] DEVICE FOR DISPENSING BEVERAGES

[75] Inventors: Birger Eriksson, Tyresö; Gösta Boström, Farsta, both of Sweden

[73] Assignee: EMAC AB, Stockholm, Sweden

[21] Appl. No.: 951,262

[22] Filed: Oct. 13, 1978

[30] Foreign Application Priority Data

Oct. 18, 1977 [SE] Sweden ..... 7711743

[51] Int. Cl.[3] ..... B67D 5/64

[52] U.S. Cl. ..... 222/160; 222/214

[58] Field of Search ..... 417/477; 222/214, 105, 222/94, 160, 166, 184, 185; 141/360-362; 312/335, 338, 339, 342

[56] References Cited

U.S. PATENT DOCUMENTS

| | | | |
|---|---|---|---|
| 2,909,125 | 10/1959 | Daniels | 417/477 |
| 2,929,535 | 3/1960 | Fairbanks | 141/361 X |
| 3,112,047 | 11/1963 | Weinreich et al. | 222/105 |
| 3,179,292 | 4/1965 | Terry | 312/338 X |
| 4,027,783 | 6/1977 | Branch et al. | 222/135 X |

*Primary Examiner*—Stanley H. Tollberg

*Attorney, Agent, or Firm*—LeBlanc, Nolan, Shur & Nies

[57] ABSTRACT

A method and apparatus for dispensing beverages from large and unwieldy replaceable containers, in which the beverage is delivered to the dispensing site. To avoid the need to raise the container to a height permitting gravity feed, and to simplify or eliminate the cleaning of the dispensing apparatus, a hose or tube is connected at one end to the outlet of the container which is located below the level of the dispensing counter, and provides a dispensing outlet at its other end. Pumping is performed by a pump having a rotary element engaging the exterior of the hose.

3 Claims, 3 Drawing Figures

DEVICE FOR DISPENSING BEVERAGES

This invention relates to a method of pouring out beverages, such as milk, juice etc. from relatively large packages positioned beneath a pouring counter, the beverages being conveyed from the package to an outlet above the pouring counter. The invention also relates to a device for carrying out said method.

To schools, military quarterings, bars, canteens and other dining halls where beverages such as milk, juice etc. are consumed in large quantities, the respective beverage is delivered in a large parallelepiped package, which preferably consists of rigid cardboard with an internal bag of plastic material holding 20 liters and which is provided with an outlet hose projecting from the internal bag and closed at its outer end.

Heretofore, the large package concerned has been suspended above a pouring counter, with its outlet hose directed downward. The closed outer end of the hose is opened by cutting off an end portion and thereafter closed by means of a clamp about the hose or by connection to a valve means. This arrangement shows particularly the inconvenience that hard work is required to lift the heavy package up from the floor or possibly from a carriage to a height of above 1.5 m. This subjects especially the back of the lifting person to stresses, which due to their frequent recurrence give rise to annoying back injuries.

In order to avoid said inconvenience, in some cases a pump with a pump room, for example a plunger pump or the like, is mounted beneath the pouring counter. The pump outlet is connected by a duct to the outlet above the pouring counter, and the pump inlet is connected to the outlet hose of the package. The package, thus, must not be lifted to some appreciable height. This arrangement, however, shows the inconvenience that it is very difficult to dismount and reliably clean the pump and its connections preferably after each period of use.

The present invention has the object to eliminate the aforesaid inconveniences by such a method and device for pouring out beverages from bulk packages that, for example, no lifting of the packages above the pouring counter is required, and the cleaning operation is dispensable or easy to carry out.

This object is achieved according to the present invention by the method and device characterized by the features defined in the attached claims.

The device according to the invention is explained in the following, with reference to the description of some embodiments shown in the accompanying drawings.

Figure 1:
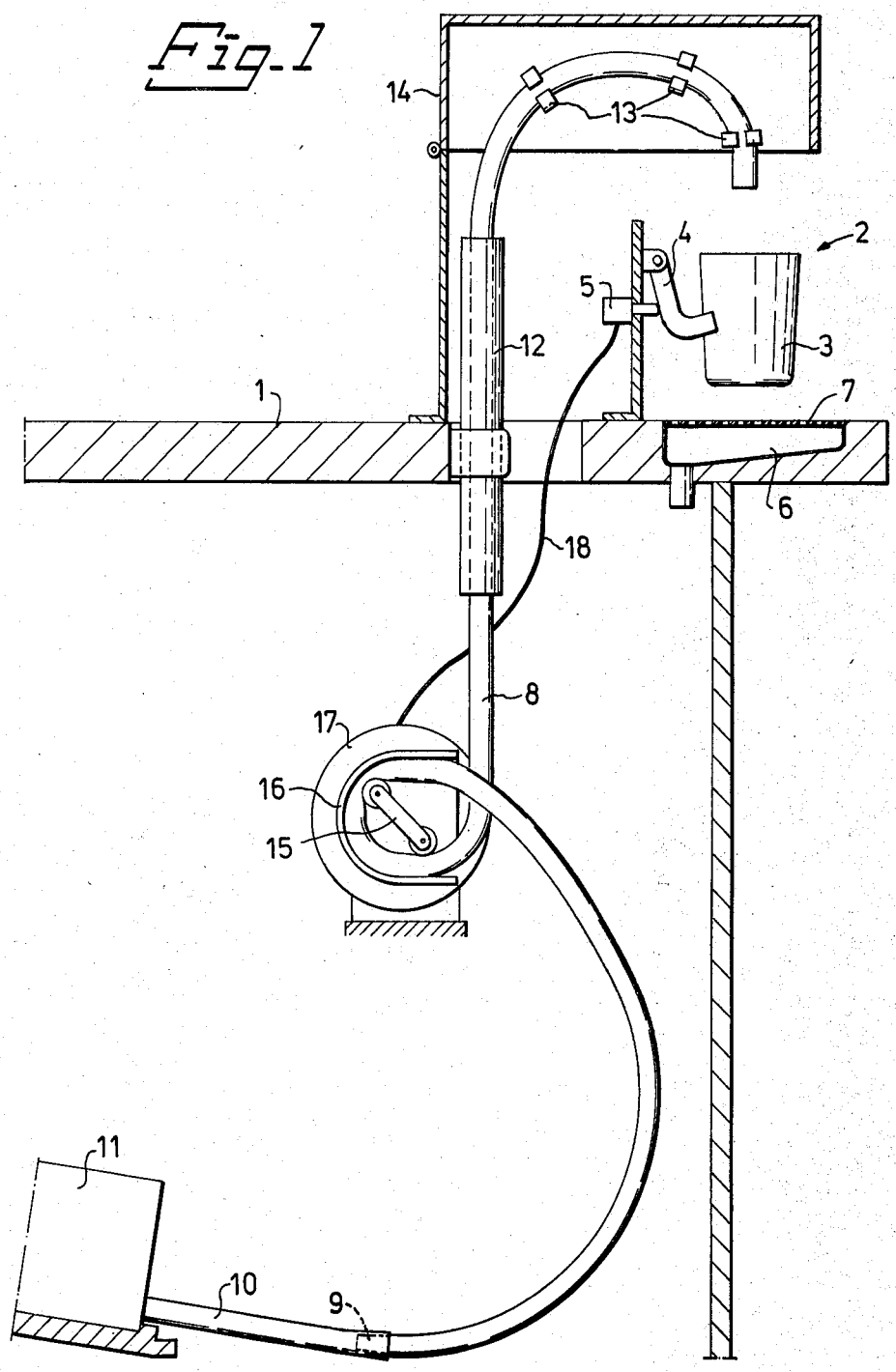
FIG. 1 is a schematic lateral view and vertical section of a pouring device according to the invention.

According to the embodiment of the pouring device shown in FIG. 1, a pouring place 2 is provided in known manner above a pouring counter 1 for attaching a drinking-vessel, for example a glass 3, to a pivotal arm 4, which rests on a contact means 5 supported on the counter 1. In the counter part located beneath the pouring place 2 a drop drain 6 covered by a strainer plate 7 is provided.

According to the present invention, an integral hose 8 is laid so that one end is located at the pouring place 2 and the other end is connected via a hose connection

9 to an outlet hose 10 at a package 11 located beneath the counter 1 and holding, for example, 20 liters of milk. The hose 8 is passed through a sleeve 12 attached to the counter 1, and from there the hose is curved and detachably mounted in clamps 13 under a carrying cover 14, which may be foldable vertically upward, so that the end portion of the hose 8 is directed downward to the glass 3.

The portion of the hose 8 located beneath the counter is laid so as to form a coil through a pump means 16 provided with a rotary pump member 15, which pump means can be driven by an electric motor 17, which has its operation control means connected to the contact means 5 by a conductor 18.

When the device described is to be operated, the hose 8 is passed through the clamps 13, the sleeve 12 and the pump means 15, 16 as shown in FIG. 1. A package 11 is put into position, and its outlet hose 10 is opened by a cut-off and connected to the hose 8 by means of the coupling 9. When a glass or the like is being pressed against the lever 4, the contact means 5 is closed, the motor 17 starts and actuates the pump member 15 to rotate, so that milk is advanced, i.e. upward in the hose 8 to the outlet thereof as long as the glass is held against the lever, whereafter the motor stops and the milk flow is interrupted.

The device especially offers the advantage, that the milk passing from the package to the outlet will be in contact only with the interior of the outlet hose 10 and of the hose 8, but not with any valve and pump room as is the case when, for example, plunger pumps are used. When the package is emptied, the connection 9 is detached, and the next package can be connected. The hose 8 easily can be removed in its entirety and possibly be cleaned. The hose, however, is intended to be discarded and be replaced by a new hose after having been in operation one day or a shorter period. As the package must not be lifted above the counter, the device according to the invention renders it possible to use larger packages holding, for example, 40–50 liters, which is most desirable.

Figure 2:
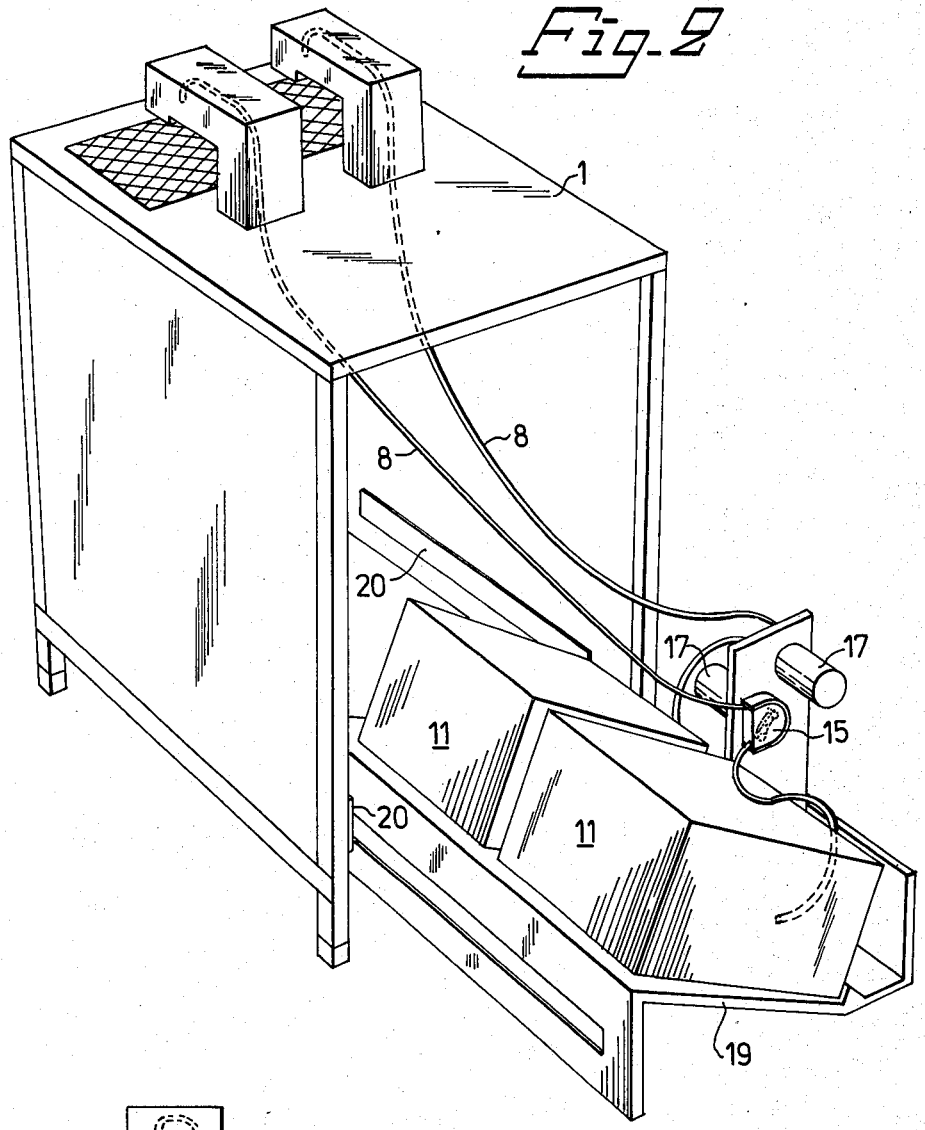
FIG. 2 is a perspective lateral view of a modified device according to the invention.

The pouring device shown in FIG. 2 is provided with two pouring places, which substantially comprise the same details as the device according to FIG. 1. The details have the same reference numerals as in FIG. 1, though there are differences with respect to the outer design. FIG. 2, thus, shows a counter 1, hoses 8 laid each through a pump means 15,16 with motor 17, and packages 11 for milk and juice, for example. The packages are placed on a shelf 19 with inclined shelving which is movable in guides 20 attached in the counter. Control means 4,5,18 for the respective motor 17 are provided, but not shown. Also this embodiment offers the advantages described above with reference to FIG. 1, and in addition the advantage that two different beverages can be poured out simultaneously.

Figure 3:
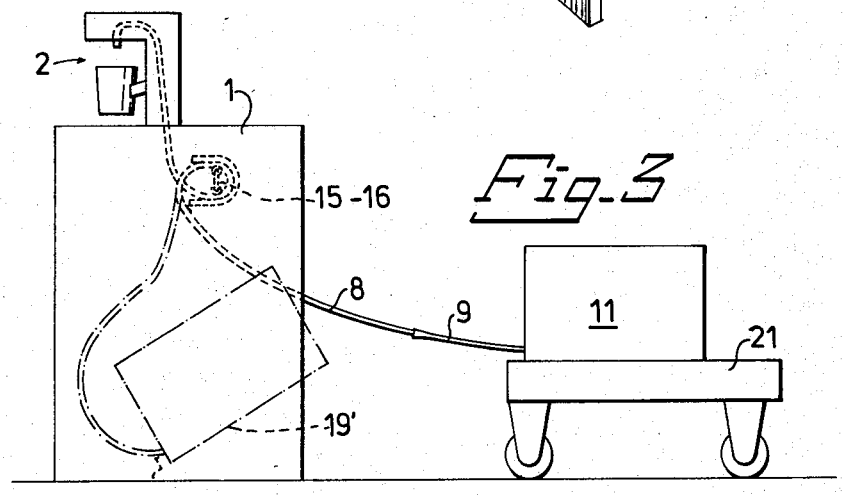
FIG. 3 is a lateral view of a further modified device according to the invention.

The device shown in FIG. 3 also shows substantially the same details as the device according to FIG. 1, viz. a counter 1 with pouring place 2 and a hose 8, which is laid through a motor-operated pump means 15,16 and via the connection 9 is coupled to the outlet hose 10 from the package 11, which has been supplied on a carriage 21, from which the package can be tilted down on the shelf 19' to the position indicated by dash-dotted lines. Also in this case, thus, the package is positioned easily and simply into serving position for its emptying. No cleaning is required, because the entire hose 8 is exchangeable.

The invention is not to be regarded restricted only to the embodiments described above and shown in the drawings, because it can be modified particularly with respect to its details. The package, for example, may stand upright with the outlet hose directed downward, or the hose can be abandoned and the hose from the pump be inserted into the package down to the bottom thereof.

We claim:

1. An apparatus for pouring beverages, such as milk, juice, etc., from relatively large beverage packages holding, for example, 20 liters or more, and having an outlet, said apparatus comprising: a pouring counter having a pouring place; a beverage dispensing hose mounted in said apparatus near said counter having an inlet end and an outlet end, said inlet end adapted to be connected to the outlet of the beverage package; a motor operated rotary pump means mounted in the apparatus with a rotary pump member adapted to engage and operate on said hose; means under the counter for accommodating at least one beverage package; said hose being integral between its two ends; said apparatus having means for supporting said hose including guide means which enable passage of a portion of said hose from below to above said counter and detachable clamp means above said counter for holding and suspending a terminal portion and outlet end of said hose above said counter with the outlet end being directed downwardly to provide a pouring outlet above said pouring place; an intermediate portion of said hose being removably connected in operative assembly in a liquid transporting section of said pump means with the rotary pump member engaging against the outside of said hose; said means for accommodating the beverage package is shelf means secured beneath said pouring counter providing an inclined shelving for supporting at least one package in a position with its outlet obliquely and downwardly directed; and means under said pouring counter are provided with guide bars for slidably supporting the shelving for movement into inserted and projected positions whereat said shelving can be loaded with said at least one package in a position while out from under the counter.

2. Apparatus as defined in claim 1 wherein means mount said pump means on said inclined shelving for movement therewith.

3. An apparatus for pouring beverages, such as milk, juice, etc., from relatively large beverage packages holding, for example, 20 liters or more, and having an outlet, said apparatus comprising: a pouring counter having a pouring place; a beverage dispensing hose mounted in said apparatus near said counter having an inlet end and an outlet end, said inlet end adapted to be connected to the outlet of the beverage package; a motor operated rotary pump means with a rotary pump member adapted to engage and operate on said hose; means in said apparatus mounting said rotary pump means, said means mounting said pump means being supported under said counter for movement between positions under said counter and out from under said counter; means under the counter for accommodating at least one beverage package; said hose being integral between its two ends; said apparatus having means for supporting said hose including guide means which enable passage of a portion of said hose from below to above said counter and detachable clamp means above said counter for holding and suspending a terminal portion and said outlet end of said hose above said counter with the outlet end being directed downwardly to provide a pouring outlet above said pouring place; and an intermediate portion of said hose being removably connected in operative assembly in a liquid transporting section of said pump means with the rotary pump member engaging against the outside of said hose.

* * * * *